US005435091A

United States Patent [19]

Toole et al.

[11] Patent Number: 5,435,091

[45] Date of Patent: Jul. 25, 1995

[54] HANDGUN SIGHTING DEVICE

[75] Inventors: Ronald L. Toole, Milwaukie; Lewis A. Danielson; Stanley F. Heard, both of Portland, all of Oreg.

[73] Assignee: Crimson Trace Corp., Portland, Oreg.

[21] Appl. No.: 102,569

[22] Filed: Aug. 5, 1993

[51] Int. Cl.[6] ..... F41G 1/34

[52] U.S. Cl. ..... 42/103; 362/114

[58] Field of Search ..... 42/103; 362/110, 114, 362/111, 112, 113

[56] References Cited

U.S. PATENT DOCUMENTS

| | | | |
|---|---|---|---|
| 794,924 | 7/1905 | Cailliez | 362/114 |
| 894,306 | 7/1908 | Wright | 42/103 |
| 1,045,800 | 11/1912 | Lewis | 362/114 |
| 1,070,883 | 8/1913 | Forrester | 362/114 |
| 1,120,769 | 12/1914 | Villarejo | 42/103 |
| 1,149,705 | 8/1915 | Ward | 42/103 |
| 1,191,528 | 7/1916 | Midgley | 362/114 |
| 1,215,171 | 2/1917 | Lewis | 42/103 |
| 1,263,667 | 4/1918 | Henderson et al. | 362/114 |
| 1,993,979 | 3/1935 | Reed | 362/113 |
| 2,017,585 | 10/1935 | Casey | 362/114 |
| 2,629,516 | 2/1953 | Badham | 362/114 |
| 3,995,376 | 12/1976 | Kimble et al. | 42/103 |
| 4,758,933 | 7/1988 | Winberg et al. | 362/110 |
| 4,856,218 | 8/1989 | Reynolds, Jr. | 42/103 |
| 4,934,086 | 6/1990 | Houde-Walter | 362/110 |
| 4,939,863 | 7/1990 | Alexander et al. | 42/103 |
| 5,068,969 | 12/1991 | Siebert | 42/103 |
| 5,111,476 | 5/1992 | Hollenbeck et al. | 372/107 |
| 5,121,188 | 6/1992 | Patridge et al. | 372/109 |
| 5,167,446 | 12/1992 | Haroutunian | 362/110 |
| 5,177,309 | 1/1993 | Willoughby et al. | 42/103 |
| 5,179,235 | 1/1993 | Toole | 42/103 |
| 5,237,773 | 8/1993 | Claridge | 42/103 |

OTHER PUBLICATIONS

Driving Circuit Example Sheet from Toshiba.

*Primary Examiner*—Charles T. Jordan

*Attorney, Agent, or Firm*—William A. Birdwell & Associates

[57] ABSTRACT

A handgun sighting device forming an integral part of the handgun and employing a laser device for projecting a laser beam. The laser device is included in a laser assembly disposed adjacent the top portion of the handgun's handgrip rearward of the trigger and extends laterally away from the handgrip a distance sufficient to allow the projection of the laser beam, while not being obtrusive to the user. For powering the laser device, the sighting device employs driving circuitry preferably disposed within the handgrip. For selectively enabling the laser device, the sighting device employs a switch mechanism preferably accessible on the handgrip. The sighting device, in one embodiment, is adapted for use with handguns having handgrips with removable grip panels and, in another embodiment, is adapted for use in handguns that do not employ removable grip panels.

23 Claims, 5 Drawing Sheets

HANDGUN SIGHTING DEVICE

BACKGROUND OF THE INVENTION

This invention relates to handgun sighting devices, particularly to handgun sighting devices that project a laser beam and that are adapted to form an integral part of a handgun.

In law enforcement, it is generally desirable to employ sighting devices in conjunction with handguns in order to optimize officers' targeting accuracy. Sighting devices that project laser beams are particularly desirable because, when the handgun is fired within a predetermined range, the laser beam can accurately target the impact point of the bullet by illuminating a spot on the targeted person or thing. Use of such a sighting device optimizes targeting accuracy under the adverse conditions commonly encountered when police officers are called on to fire their handguns, thereby lessening the likelihood of unintended injury to bystanders by an inaccurately fired bullet.

Prior sighting devices employing lasers have been in the nature of "add-on" structures attached to regulation handguns in an obtrusive and ungainly manner. Often, the devices hinder insertion of the handguns to which they are attached in a regulation holster. Moreover, the devices are easily damaged or unintentionally disengaged from the handgun unless substantial care is diligently exercised. These prior sighting devices have also been difficult to adjust with respect to the targeting range and, even when properly adjusted, the adjustment can be readily lost as a result of daily, often rigorous, police activities. These prior sighting devices have often had limited application to handguns having either metal frames or polymer frames, but not both.

The present application is an improvement to U.S. Pat. No. 5,179,235 (the "Toole '235 Patent") issued Jan. 12, 1993 to Toole, incorporated by reference herein. The pistol sighting device disclosed in the incorporated reference overcomes the disadvantages of prior sighting devices to a large extent by providing a sighting device which is substantially integral with a pistol or similar weapon so as to avoid obtrusive parts and which is easily and accurately adjustable. The sighting device has a laser device that is integrally positioned on the forward, substantially vertical portion of the pistol's trigger guard, mounted thereon using a universal positioning means. The sighting device's power supply is located within the rearward side of the pistol's handgrip behind the magazine well thereof, in a compartment provided by removing excess material at the back of the handgrip to complete an elongated recess in substantially parallel relation to the magazine well. The power supply is connected to the sighting device's laser device by a cable that extends from the power supply to the laser device through grooves and bores drilled in the handgrip and the trigger guard of the pistol. Accordingly, the sighting device is limited in that its integration in a handgun requires substantial milling and drilling in order to connect the power supply to the laser device.

Because prior sighting devices that project laser beams have inherent limitations, a need exists for an improved handgun sighting device.

SUMMARY OF THE INVENTION

The present invention fulfills the aforementioned need by providing a novel and improved handgun sighting device forming an integral part of the handgun and employing a laser device for projecting a laser beam onto the impact point of the intended target. The laser device in a preferred embodiment is a laser diode disposed within a laser assembly preferably having a mechanism for adjusting the targeting of the diode's laser beam. The laser assembly is disposed adjacent the top portion of the handgun's handgrip rearward of the trigger. The laser assembly extends laterally away from the handgrip a distance minimally sufficient to allow the projection of the laser beam onto the target, while not being obtrusive to the user. The laterally extending portion of the laser assembly preferably has a contoured exterior to minimize obtrusiveness. The sighting device also employs driving circuitry for powering the laser device, the driving circuit preferably being disposed within the handgrip. The sighting device further employs a switch mechanism for selectively enabling the laser device, preferably accessible on the handgrip so as to be operable by the user when the user grasps and aims the handgun.

The sighting device, in one embodiment, is adapted for use with handguns having handgrips with removable grip panels wherein the laser assembly, the driving circuitry and, preferably, the switch mechanism are integrated in a grip panel. The sighting device, in another embodiment, is adapted for use in handguns that do not employ removable grip panels, wherein the laser assembly, the driving circuitry and, preferably, the switch mechanism are integrated in a grip panel disposed in a lateral side of the handgrip.

Accordingly, it is a principle object of the present invention to provide a novel and improved handgun sighting device for a pistol, revolver or other handgun or similar weapon.

It is another object of the present invention to provide a handgun sighting device which forms a substantially integral part of a handgun.

It is a further object of the present invention to provide a handgun sighting device that enables accurate targeting of the handgun, particularly in the adverse conditions commonly encountered by police.

It is yet another object of the present invention to provide a handgun sighting device that is unobtrusive so as not to impede operation of the handgun.

It is yet a further object of the present invention to provide a handgun sighting device which is easily operated by the user in conjunction with the operation of the handgun.

It is another object of the present invention to provide a handgun sighting device that is easily and accurately adjustable, while being resistant to disturbance in adjustment.

It is yet another object of the present invention to provide a handgun sighting device that can be easily and inexpensively retrofitted onto handguns that use removable grip panels.

It is yet a further object of the present invention to provide a handgun sighting device that can be used with all handguns, including those having metal or polymer frames.

It is another object of the present invention to provide a handgun sighting device that does not hinder insertion of the handgun in a holster, particularly a standard issue police holster.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
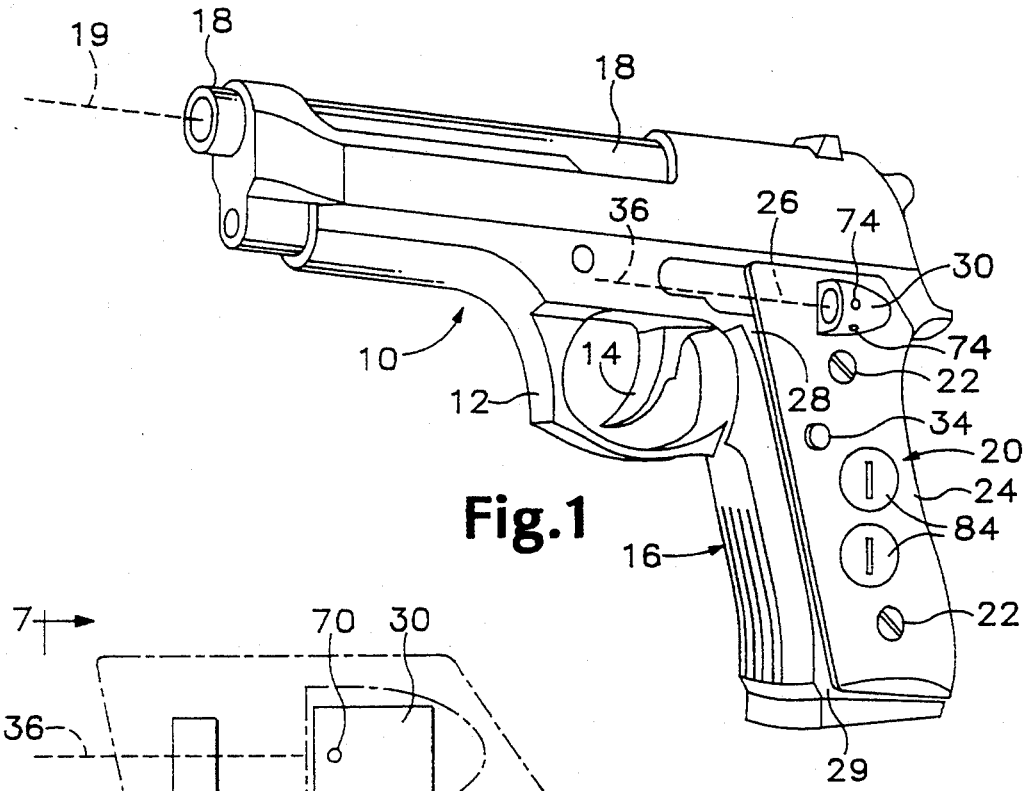
FIG. 1 is a perspective view of a handgun having a removable grip panel incorporating a preferred embodiment of a handgun sighting device according to the present invention.
Figure 2:
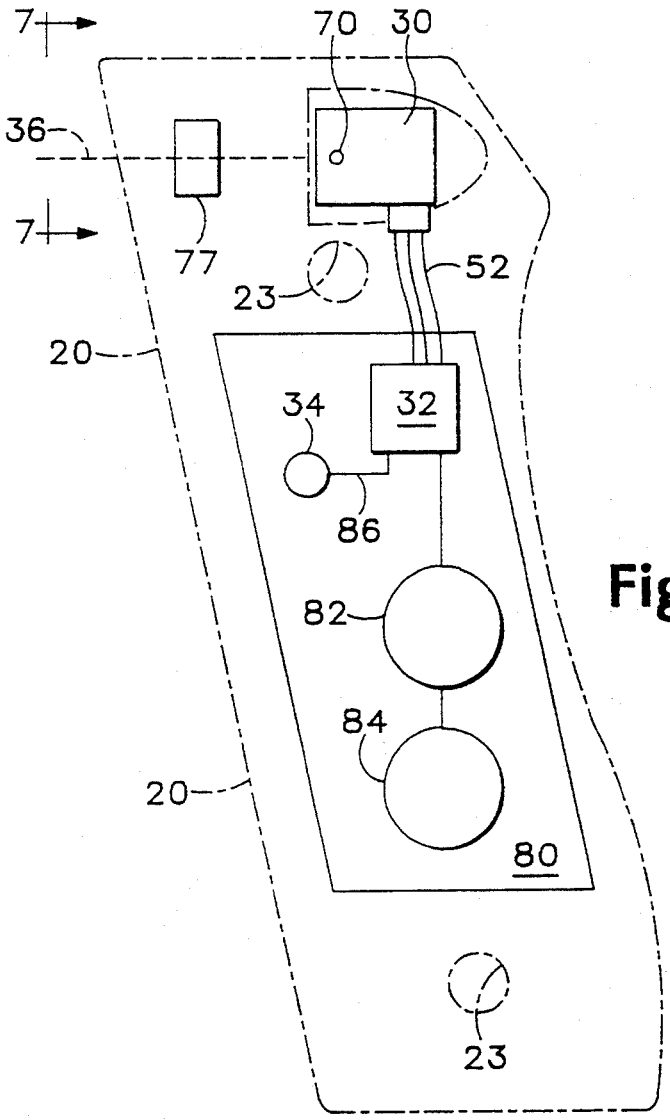
FIG. 2 is a side view of the sighting device of FIG. 1, showing the driving circuitry for a laser device in block diagram form and showing a grip panel in phantom.
Figure 3:
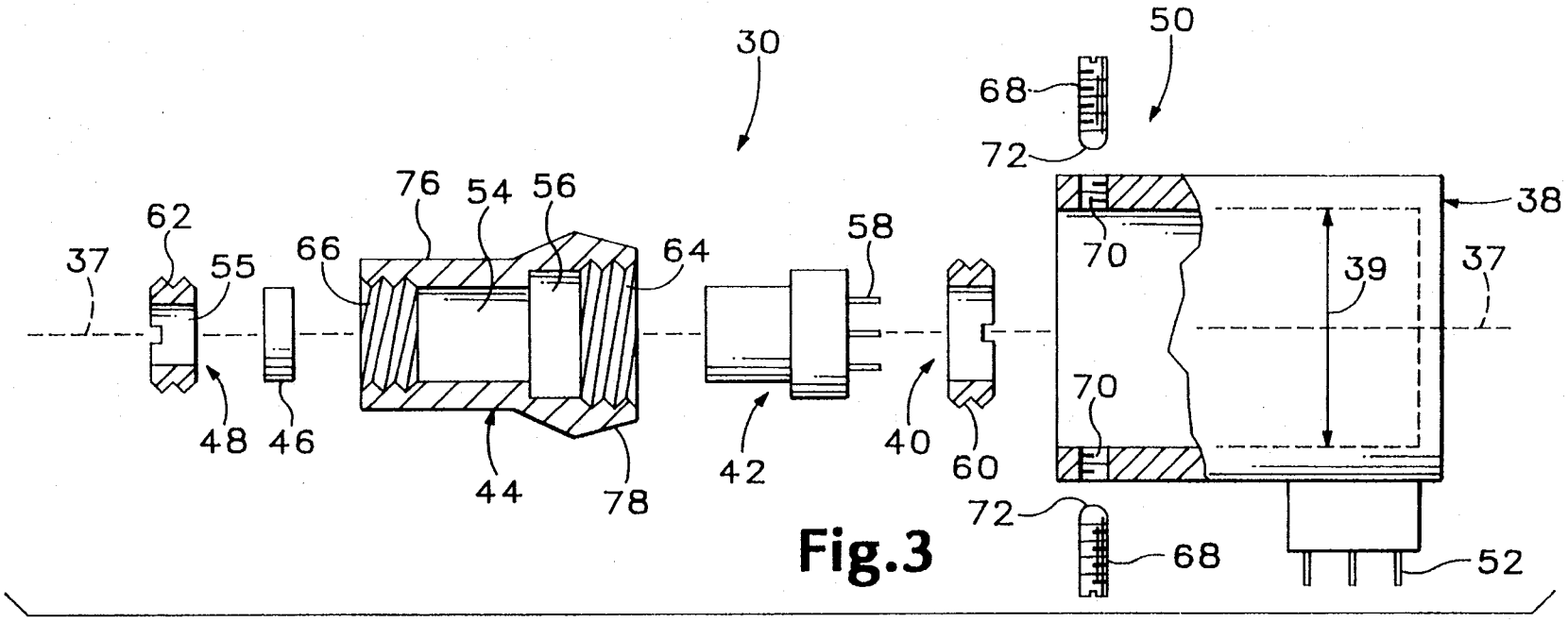
FIG. 3 is an exploded view of a laser assembly showing a laser device as part thereof.

Referring to FIGS. 1, 2 and 3, a handgun sighting device according to the present invention is illustrated in use with a handgun. The handgun, in this case a pistol, includes a frame 10 having a trigger guard 12, a trigger 14 and a handgrip 16. The frame 10 has mounted thereon a barrel 18 having central axis 19. The handgrip 16 has a top portion 26, a front portion 28 and a lateral side 29, and at least one removable grip panel 20 attached to a respective lateral side. The grip panel 20 preferably is removably attached to the handgrip 16 by screws 22 inserted through screw apertures 23 provided in the grip panel 20. The grip panel 20 has a lateral surface 24. Although the grip panel 20 as shown is of the variety that removably attaches to one lateral side of the handgrip 16, it is to be recognized that the grip panel 20 may be of any other variety, such as conventional slip-on or wrap-around varieties, without departing from the principles of the invention.

The handgun sighting device comprises a laser assembly 30, driving circuitry 32 and a switch mechanism 34. The laser assembly 30 projects a laser beam 36 in substantially intersecting relation to the trajectory of a bullet (not shown) fired from the barrel 18. The laser assembly 30 is disposed adjacent the top and front portions 26 and 28 of the handgrip 16 and, being disposed in the grip panel 20, it forms an integral part of the handgrip 16. Having the laser assembly 30 so disposed, a user grasping the handgun by the handgrip 16 with the user's forefinger positioned on the trigger 14 will naturally leave the front of the laser assembly 30 uncovered and, thereby, the laser beam 36 will be unobscured for targeting. Although in FIG. 1 the laser assembly 30 is shown disposed on one side of the handgun, it is to be recognized that the laser assembly may be disposed on either side of the handgun, for example to accommodate left and right handed users, as well as preferences, without departing from the principles of the invention.

Referring to FIGS. 2 and 3, the grip panel 20 of FIG. 1 is shown removed from the handgrip 16, with screws 22 removed from the screw apertures 23, and a preferred embodiment of the laser assembly 30 is shown exploded along reference axis 37, which preferably is substantially parallel to the central axis 19 of the barrel 18. The laser assembly comprises an assembly housing 38, a first retainer 40, a laser device 42, a laser device holder 44, a lens 46, a second retainer 48 and, preferably, adjustment screws 68 and 69. The laser assembly 30 has interconnectors 52 provided adjacent the rearward side of the assembly housing 38 to electrically interconnect the laser device 42 to the driving circuitry 32.

The assembly housing 38 comprises a hollow member having predetermined internal dimensions sufficient to receive therein the other elements of the laser assembly 30. In a preferred embodiment the assembly housing is tubular, having a predetermined internal diameter 39.

The laser device holder 44 has an aperture 54 therethrough that preferably is cylindrical. The laser device holder 44, at the rearward side thereof, has a recess 56 that preferably is cylindrical, is concentric with the aperture 54 and has a diameter predetermined to accommodate the laser device 42. The laser device holder 44 receives the laser device 42 in the aperture 54, seating the laser device 42 in the recess 56. The laser device 42 is fixed within the laser device holder 44 by inserting the first retainer 40 in the recess 56 rearwardly of the laser device 42. The laser device 42 has electrical leads 58 which extend through the first retainer 40, rearwardly from the laser device holder 44 when the laser device 42 is fixed therein. Although the first retainer 40 is used in the embodiment shown, it is to be recognized that the first retainer 40 may be omitted and the laser device 42 fixed within the laser device holder 44 by other means, such as by suitable glue, without departing from the principles of the invention.

The aperture 54 of the laser device holder 44, at the forward side thereof, receives the lens 46 and the second retainer 48. The second retainer 48 has an aperture 55, preferably cylindrical, disposed therethrough, through which the laser beam 36 passes. Although the lens 46 preferably is fixed in the aperture 54 of the laser device holder 44 by using the second retainer 48, it is to be recognized that other means for fixing the lens 46 in the aperture 54, such as an appropriate cement, may be used without departing from the principles of the invention.

By positioning the lens 46 in the aperture 54 closer or farther from the laser device 42, the lens 46 adjusts the laser beam 36 for size and quality.

The first retainer 40 and the second retainer 48 have respective external threads 60 and 62. The recess 56 and the aperture 54 of the laser device holder 44 have respective internal threads 64 and 66. The first retainer 40 and the second retainer 48 are, respectively, screwed into the recess 56 and the aperture 54 so as to fix them in the laser device holder 44. It is to be recognized that other means so to fix the first retainer 40 and the second retainer 48, such as frictional fitting or gluing, may be used without departing from the principles of the invention.

So assembled, the laser device 42, the laser device holder 44, the lens 46, the first retainer 40 and the second retainer 48 are received within the assembly housing 38 so that electrical leads 58 of the laser device 42 are in electrical connection with respective interconnectors 52 and, thereby, in electrical connection with the driving circuitry 32. Each electrical lead 58 preferably is soldered to the appropriate interconnector 52, but it is to be recognized that other means to electrically connect the leads 58 to respective interconnectors 52 may be used without departing from the principles of the invention.

Figure 6:
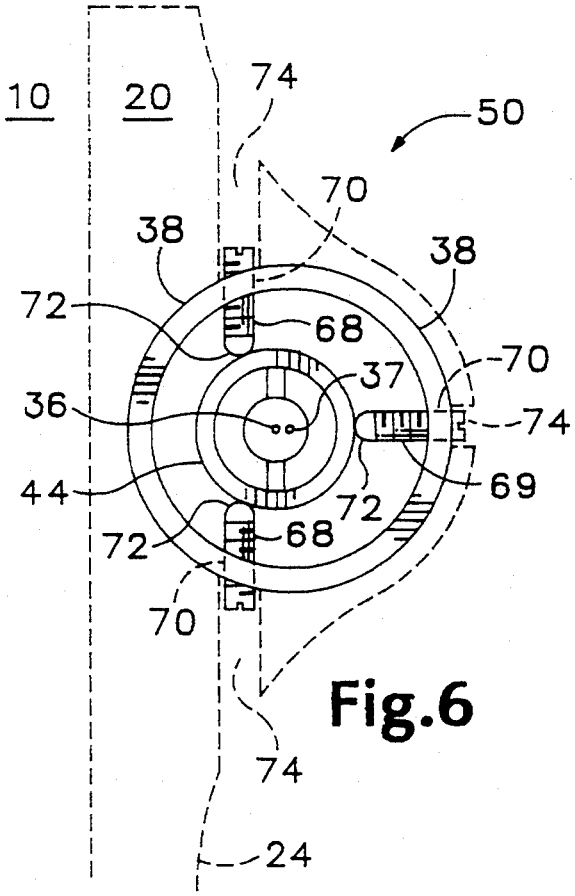
FIG. 6 is a front view of a preferred embodiment of the laser assembly, showing an adjustment mechanism according to the present invention and showing a grip panel in phantom.

An adjustment mechanism 50 preferably provides for both elevation and windage adjustments by providing for adjustment of the laser beam's projection relative to the barrel's central axis 19 in both vertical and horizontal directions. Referring to FIG. 6, the adjustment mechanism 50 preferably comprises two adjustment screws 68 and one adjustment screw 69 such that the projection of the laser beam 36 may be adjusted by tightening or loosening combinations of the respective adjustment screws 68 and 69.

The adjustment screws 68 and 69 preferably are disposed in respective threaded adjustment apertures 70 of the assembly housing 38, the two adjustment screws 68 and adjustment screw 69 being accessible to the user through respective access apertures 74 disposed through the grip panel 20. The adjustment screws 68 and 69 have rounded tips 72 so as to make uniform contact with the laser device holder 44 throughout the range of adjustment. The adjustment apertures 70 are arranged at predetermined positions about the periphery of the assembly housing 38. Preferably, the adjustment apertures 70 are arranged so that, when the projection of the laser beam 36 is adjusted to be co-linear with the reference axis 37, the tips 72 of the screws 68 and 69 are substantially at 120° angles to each other, measured relative to the reference axis 37. The two adjustment screws 68 preferably are disposed on a line forming a non-diametric chord across the circular cross-section of the assembly housing 38, the chord being perpendicular to the direction of adjustment provided by the adjustment screw 69. So disposed, the adjustment screws 68 may be tightened to force the laser device holder 44 away from the handgrip 10 in the direction opposite to that provided by tightening the adjustment screw 69. The adjustment screws 68 may also be used to adjust the position of the laser device holder 44 along the chord of the screws 68.

In a preferred embodiment having an adjustment mechanism 50 comprising the adjustment screws 68 and the adjustment screw 69, the laser device holder 44 preferably is elongate, having a substantially cylindrical forward portion 76 and a prism-shaped rearward portion 78. The forward portion 76 has a diameter selected relative to the internal diameter 39 of the assembly housing 38 so that it may accommodate a predetermined adjustment range. The rearward portion 78 has a cross-sectional dimension somewhat greater than the diameter of the forward portion 76 so as to provide a pivot for adjusting the forward portion 76 using the adjustment screws 68 and 69. The shape of the rearward portion 78 is also selected to provide sufficient mass to sink heat generated by the laser device 42.

Although the adjustment mechanism 50 preferably comprises the three-screw arrangement, it is to be recognized that the adjustment mechanism 50 may comprise other adjustment means, such as the adjustment mechanism set forth in the Toole '235 Patent incorporated herein by reference, without departing from the principles of the invention. Moreover, it is also to be recognized that the adjustment mechanism 50 may be separate from the laser assembly 30, such as being provided by rotating or shimmed grip panels, without departing from the principles of the invention.

Figure 7:
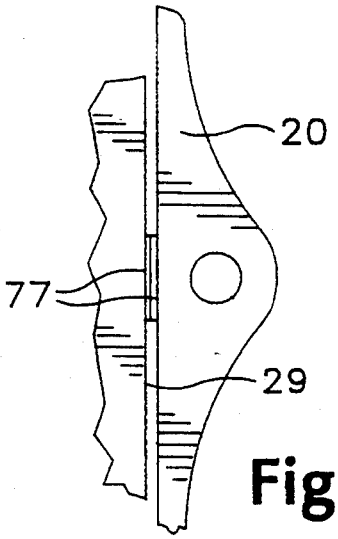
FIG. 7 is a section taken along line 7—7 in FIG. 2 showing a shimmed grip panel for adjusting the present invention.
Figure 8:
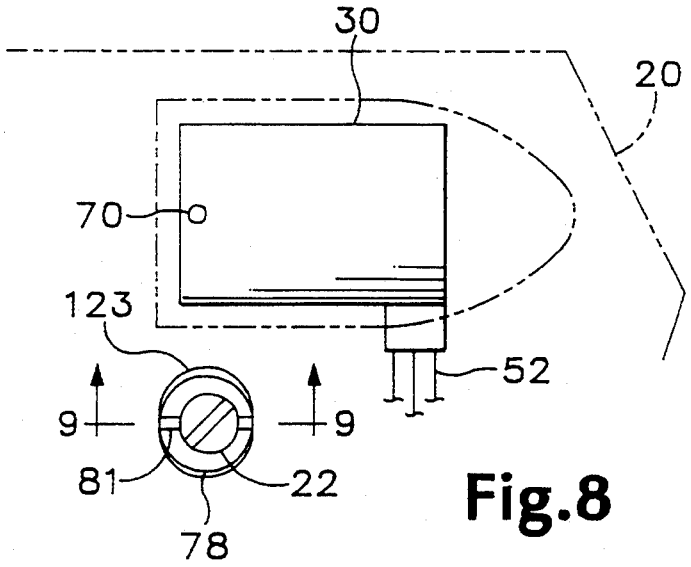
FIG. 8 is a cut away view of the embodiment of FIG. 2 showing features of an adjustment mechanism comprising a rotatable grip panel.
Figure 9:
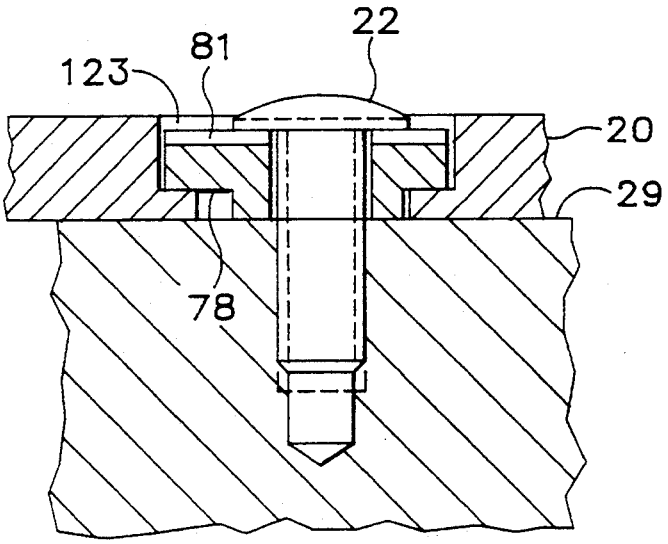
FIG. 9 is a cross-section taken along line 8—8 in FIG. 8 showing an adjustment mechanism for a rotatable grip panel, the adjustment mechanism comprising a screw disposed in an eccentric washer disposed in a recess in the hand gun's grip panel.

Referring to FIG. 7, one example of the shimmed grip panel is shown. One or more shims 77 may be disposed between the lateral side 29 of hand grip 16 and grip panel 20. Shims 77 may comprise any standard metal or plastic shim and preferably are adhesive backed. A laser sighting device disposed on grip panel 20 may be adjusted for windage by selecting a shim or shims of a thickness that will displace the grip panel to a degree necessary to effectuate the sight adjustment. FIGS. 8 and 9 illustrate the concept of a rotatable grip panel. A screw 22 is disposed through an eccentric washer 78 disposed in recess 123, recess 123 being elongated slightly in a vertical direction and adapted to cooperate with eccentric washer 78 so as to impart force on grip panel 26 to rotate grip panel 26 about a pivot point such as screw 22 disposed near the butt end of the hand gun. This lower screw 22 may also be dispose in an eccentric washer 78 disposed in recess 123 the recess being adapted to cooperate with the eccentric washer to impart rotation of the grip panel. By rotating the eccentric washer adjust to the elevation of a laser sighting device may be made. Slots 81 may be provided in the eccentric to receive a spanner wrench for rotating the eccentric washer. Accordingly, a combination of the foregoing shimmed and rotatable grip panel in a hand gun can adjust a laser sighting device fixed on a grip panel for both elevation or windage. Although providing the adjustment mechanism 50 is preferred, it is also to be recognized that the adjustment mechanism may be omitted without departing from the principles of the invention.

Referring again to FIG. 2, the laser device 42, preferably a laser diode, is driven by the driving circuitry 32. The driving circuitry 32 is mounted on a circuit board 80. The circuit board 80 provides battery holders 82 for receiving coin-type batteries. Caps 84 are provided for retaining the batteries within the battery holders 82. The caps 84 may also provide a terminal for the batteries, as is commonly known in the art.

The switch mechanism 34 provides for selectively enabling operation of the laser device 42. The switch mechanism 34 is connected to the driving circuitry 32 by switch leads 86. The switch mechanism 34 preferably is disposed at a predetermined position on the lateral surface 24 of the grip panel 20 so as to provide convenient operation thereof by the user of the handgun. Preferably, the switch mechanism 34 is disposed so that, as the user grasps the handgun by the handgrip 16, the user's hand is naturally positioned relative to the grip panel 20 so as to make contact with the switch mechanism 34 such that the switch mechanism 34 is operable by selectively applying pressure thereto. Applying pressure activates the switch mechanism 34, providing power to the laser device 42 and resulting in projection of the laser beam 36.

The driving circuitry 32, interconnected to and driving the laser device 42, preferably is disposed within the grip panel 20 of the handgrip 16. Although as shown in the figures the switch mechanism 34 is disposed on the grip panel 20 adjacent the front portion 28 and toward the top portion 26 of the handgrip 16, it is to be recognized that the switch mechanism 34 may be disposed at other locations on the grip panel 20 or on other parts of the handgun, without departing from the principles of the invention. It is also to be recognized that, where adequate space exists within the handgrip 16, one or both of the battery holders 82 and driving circuitry 32 may be disposed within the handgrip 16 while the laser assembly 30 is disposed in the grip panel 20, without departing from the principles of the invention. In addition, it is to be recognized that, regardless of the disposition of the battery holders 82 and driving circuitry 32, the switch mechanism 34 and the laser assembly 30 may be disposed on opposite lateral sides of the handgrip 29, such as by being disposed on separate grip panels attached respectively to opposite lateral sides of the handgrip 16 or by being on opposite sides of a slip-on or wrap-around grip panel.

The switch mechanism may comprise a mechanical pressure switch, a heat sensitive switch, an electrical contact switch or other suitable switch.

Figure 5:
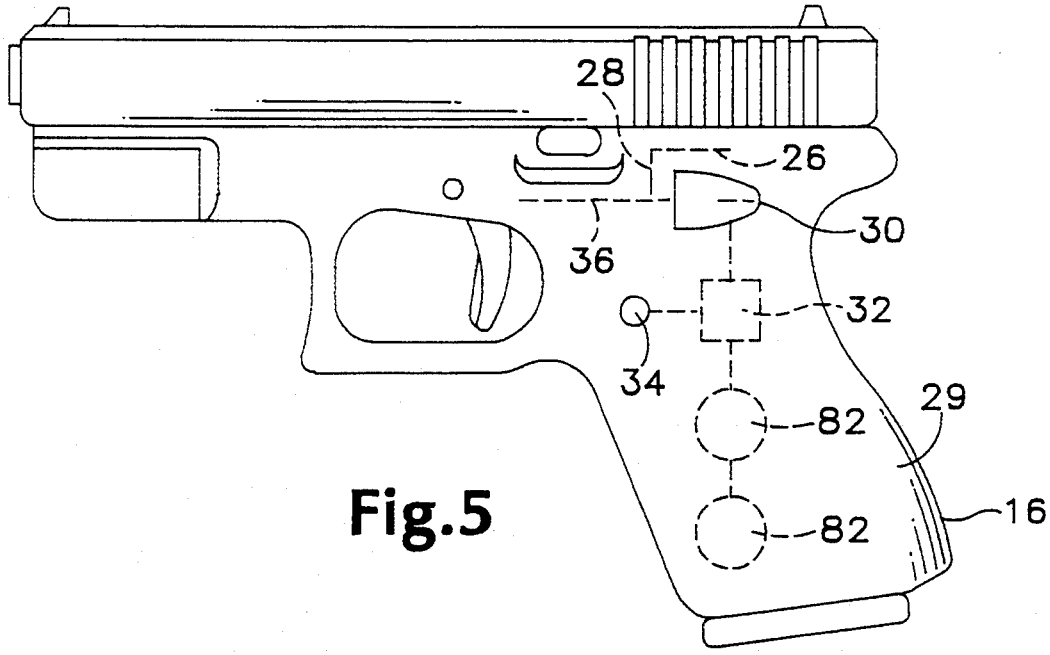
FIG. 5 is a side view of a handgun having a non-removable grip panel incorporating a handgun sighting device according to the present invention, showing a laser device and a switch mechanism disposed on the handgun's grip panel, and showing driving circuitry for the laser device disposed within the grip panel in hidden lines.

Although FIGS. 1 and 2 show the handgun sighting device forming an integral part of the grip panel 20, it is to be recognized that the handgun sighting device of the present invention may be used with handguns and other weapons not employing removable grip panels, without departing from the principles of the invention. As shown in FIG. 5, the handgun sighting device of the present invention is shown in use with a handgun having grip panels that are not removable, instead form an integral part of a unitary handgrip. In such embodiment, the laser assembly 30, the driving circuitry 32 and the switch mechanism 34 are substantially the same as described above and may be understood by reference to that description. Thence, the laser assembly 30 is an integral part of the handgrip 16, disposed as part of the integral grip panel adjacent the top portion 26 and front portion 28 of the handgrip 16, the relative locations of portions 26 and 28 being shown in phantom lines. Similarly the driving circuitry 32 is disposed within the handgrip 16, preferably in the lateral side 29 thereof, and the switch mechanism 34 preferably is disposed at a position on the integral grip panel on the surface of the handgrip's lateral side 29 so as to provide convenient operation thereof by the user, as described above for the removable grip panel embodiment.

Figure 4:
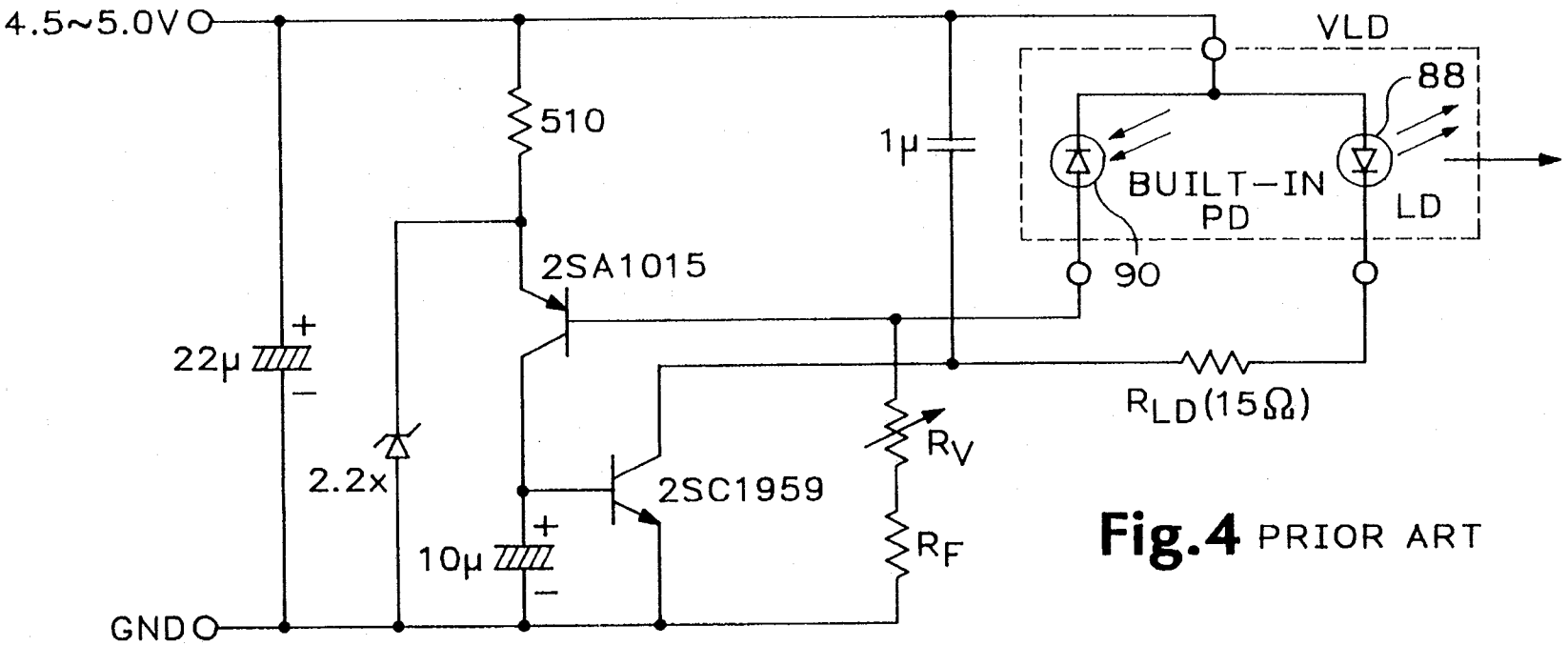
Fig.4 PRIOR ART
FIG. 4 is a schematic diagram of exemplary driving circuitry for a laser device employed in accordance with the present invention.

Referring to FIG. 4, a schematic diagram illustrating the driving circuitry 32 is shown for driving a laser device 42 having a laser diode 88 and a photodiode 90. The structure and operation of the laser device 42 and the driving circuitry 32 shown in FIG. 4, can be readily understood by a person of ordinary skill, is known in the art and is not further discussed.

Referring to FIGS. 1 and 5, the handgun sighting device is structurally unobtrusive, being disposed adjacent the top portion 26 of the handgun's handgrip 16 and extending laterally from the removable or integral grip panel 20 a predetermined distance depending on the embodiment. The distance of lateral extension preferably is minimally sufficient to allow the projection of the laser beam 36 onto a target. To minimize obtrusiveness, the laser assembly 30 preferably is covered by the material from which the respective grip panel 20 or handgrip 16 is fabricated, the covering being contoured and tapered from forward to rearward to smooth the transition between the laser assembly 30 and the respective grip panel 20 or handgrip 16.

So integrated in the handgun, the handgun sighting device tends not to be struck during police activities and, even when struck, the shock tends to be distributed to the handgun's frame 10. Consequently, the handgun sighting device resists disturbance in adjustment. Moreover, the handgun sighting device does not hinder insertion of the handgun in a holster, particularly a standard issue police holster. Because the handgun sighting device of the present invention can be incorporated in removable grip panels, the sighting device is easily and inexpensively retrofitted onto handguns that use such removable grip panels.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A sighting device for a handgun having a handgrip, the sighting device comprising a laser device disposed in the handgrip above the butt end of said handgrip so as to project a laser beam in substantially intersecting relation to the trajectory of a projectile fired from the handgun.

2. The sighting device of claim 1, wherein said laser device is disposed toward one side of said handgrip so that the laser beam is projected along a side of the handgun.

3. The sighting device of claim 1, wherein said laser device forms an integral part of the handgrip.

4. The sighting device of claim 1, wherein the handgrip has a top portion and said laser device is disposed adjacent said top portion of the handgrip.

5. The sighting device of claim 1, wherein said laser device comprises a laser diode.

6. The sighting device of claim 1, further comprising driving circuitry for said laser device.

7. The sighting device of claim 6 wherein said driving circuitry comprises power supply means and conducting means for connecting said power supply means to said laser device.

8. The sighting device of claim 7, wherein said driving circuitry is disposed within the handgrip.

9. The sighting device of claim 1, further comprising switch means for selectively enabling operation of said laser device.

10. The sighting device of claim 9, wherein the handgrip has a lateral side and said switch means is disposed so as to be accessible on said lateral side and operable by pressure from the hand of a user when gripping the handgrip.

11. The sighting device of claim 9, wherein said switch means is disposed on the handgun at a position separated from the handgrip.

12. The sighting device of claim 9, wherein said switch means comprises a mechanical pressure switch.

13. The sighting device of claim 9, wherein said switch means comprises a heat sensitive switch.

14. The sighting device of claim 9, wherein the handgrip includes a grip panel, said laser device and said driving circuitry being disposed within said grip panel.

15. The sighting device of claim 13, wherein the handgrip includes a grip panel having a lateral surface and said switch means is disposed so as to be accessible on said lateral surface of said grip panel.

16. The sighting device of claim 13, wherein a grip panel is removably attached to the handgrip.

17. The sighting device of claim 1, further comprising adjustment means for adjusting the direction of said laser beam.

18. The sighting device of claim 17, wherein said adjustment means further comprises elevation adjustment means and windage adjustment means.

19. The sighting device of claim 17, wherein the handgrip includes a laterally protruding portion in which said laser device is disposed and said adjustment means comprises two substantially colinear, opposing adjustment screws whose axis is offset toward the center of the handgun from the center of said laser device, and one adjustment screw having an axis substantially perpendicular to the axis of said colinear adjustment screws and being disposed in the side of said laser device opposite said colinear adjustment screws.

20. In a handgun having a handgrip including a grip panel, a sighting device comprising a laser device forming an integral part of the grip panel for projecting a laser beam in substantially intersecting relation to the trajectory of a projectile fired from the handgun.

21. The sighting device of claim 20, further comprising switch means for selectively enabling operation of said laser device and wherein said grip panel has a lateral surface and said switch means is accessible on said lateral surface of said grip panel.

22. The sighting device of claim 20, wherein said grip panel is removably attached to the handgrip.

23. The sighting device of claim 20, wherein said grip panel includes a laterally protruding portion, said laser device being disposed in said laterally protruding portion so as to project the laser beam along a side of the handgun.

* * * * *